US006250044B1

(12) United States Patent
Funk et al.

(10) Patent No.: US 6,250,044 B1
(45) Date of Patent: Jun. 26, 2001

(54) SHOWER DOOR BAR WITH RECESSED GRIP

(75) Inventors: David R. Funk; Timothy S. DeBraal, both of Sheboygan; Thomas H. Kopacz, Howards Grove, all of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/482,364

(22) Filed: Jan. 13, 2000

(51) Int. Cl.[7] ..... E06B 7/28; A47H 33/00

(52) U.S. Cl. ..... 52/782.1; 211/105.2; 211/119.009

(58) Field of Search ..... 52/782.1; 4/557, 4/605, 607; 211/105.1, 105.2, 119.004, 119.009, 119.011, 123; 49/460; 292/350; 16/414, 417, 419, 436, 441, 444, DIG. 5, DIG. 24, DIG. 4, DIG. 41; 248/201, 251

(56) References Cited

U.S. PATENT DOCUMENTS 2,134,096 * 10/1938 Andrie ..... 292/350
2,589,516 3/1952 Stelzer .
3,378,219 4/1968 Biesecker .
4,499,629 2/1985 Grossman .
5,860,538 1/1999 Duero et al. .
5,875,903 * 3/1999 Chen ..... 211/105.1

* cited by examiner

*Primary Examiner*—Michael Safavi
(74) *Attorney, Agent, or Firm*—Quarles & Brady LLP

(57) ABSTRACT

A towel bar attachable to bypass style shower doors. The towel bar has a support bar with two ends engaged with flanged escutcheons. The support bar and escutcheons are located at one side of a door with the escutcheons covering suitably sized and spaced apertures in the door. Two flanged fasteners are inserted into the door apertures from an opposite side of the door to mate with the bar ends. Tightening the fastener biases the flanges toward opposite surfaces of the door to secure the towel bar to the door. The fasteners each have a recessed grip defining handles for sliding the door from the side opposite that from which the bar projects.

8 Claims, 5 Drawing Sheets

FIG. 1
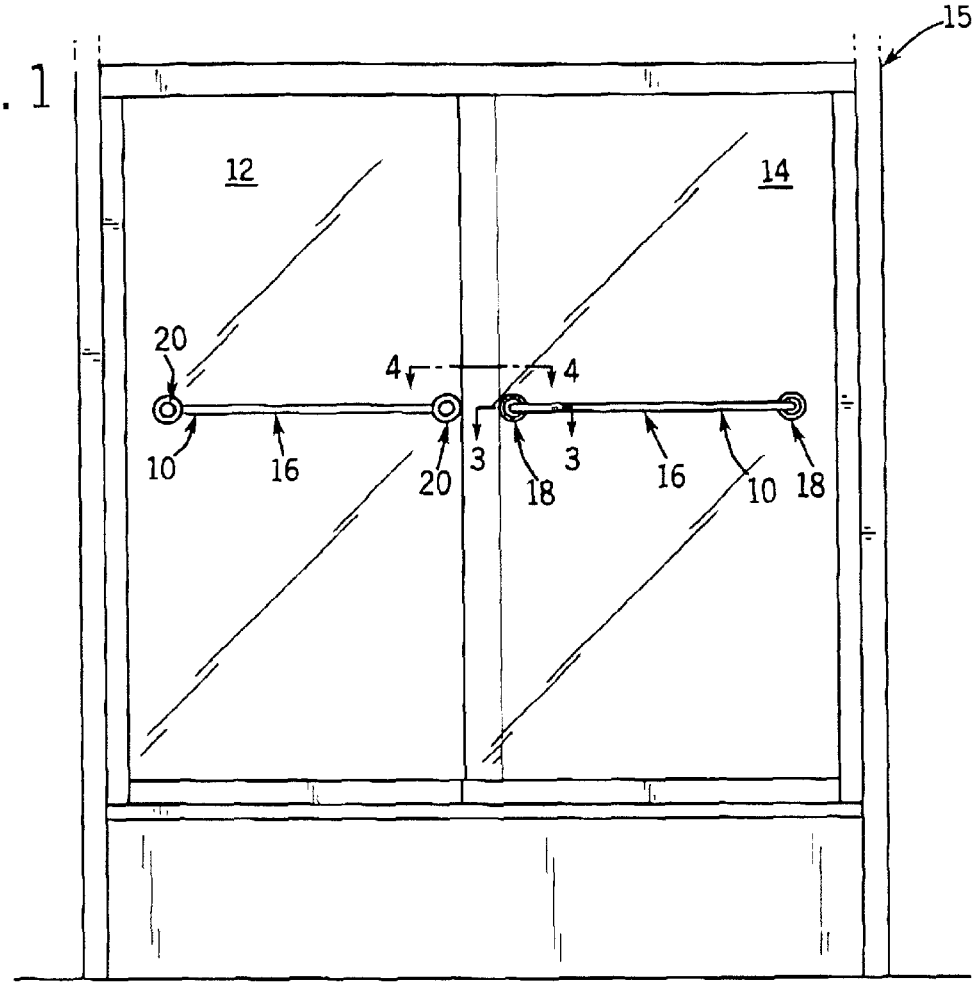
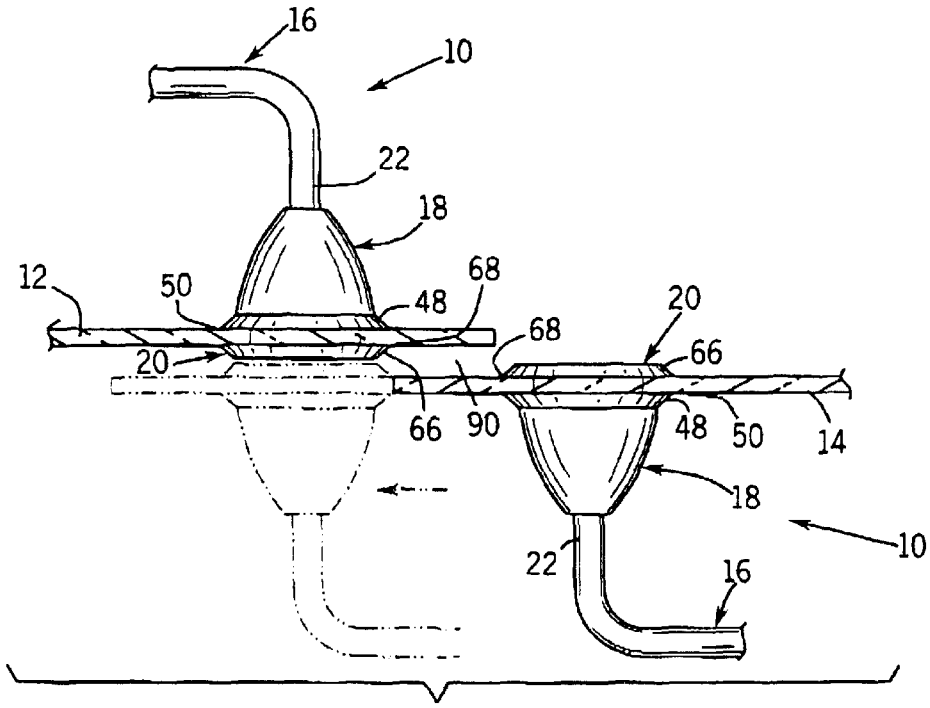
FIG. 4

SHOWER DOOR BAR WITH RECESSED GRIP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

"Bypass" type sliding shower doors can cover the entry to a shower stall. They often have glass or plastic door panels contained within metal frames which slide along parallel tracks. The doors are typically sized to overlap in the center of the entry. Narrow spacing between the tracks and the overlap prevent water from splashing out between the doors.

Such doors often have towel/grip bars mounted to the frame of each door, one door with a bar inside the shower stall and the other door with a bar outside the shower stall. See Generally U.S. Pat. No. 5,860,538.

Besides providing a place to suspend wet towels for drying, these bars also act as handles for opening and closing the shower doors. Since the doors must be spaced close together to avoid leaking, ordinarily such bars cannot be located on both sides of each door because they would prevent the doors from moving past each other. Thus, a person at one side of the shower stall entryway can easily open only one of the doors, since the other door has no corresponding bar on that side to be used as a handle.

Accordingly, an improved bar assembly for bypass shower doors is needed.

BRIEF SUMMARY OF THE INVENTION

The present invention provides a towel bar assembly for mounting on a door, such as a bypass type slidable shower door, having an opening therethrough. The assembly includes a bar having at least one attachment end, an escutcheon having a front with an axial opening in which the attachment end is disposed, and a back having a flange around a rear opening. There is also a fastener having a back end with a flange around a rearwardly directed recessed grip. The fastener is inserted in the rear opening of the escutcheon and mated with one of the escutcheon and the attachment end so that the flanges define a gap therebetween. The recessed grip is then accessible from the rear of the assembly.

In preferred forms the recessed grip is a cupped surface, the bar also has a second attachment end, and the assembly also has a second such escutcheon and a second such fastener. The fastener preferably has threads which mate with threads on the attachment end.

In another aspect the invention provides a door assembly. There is a door having front and rear sides, and an aperture extending therebetween. There is also a bar having at least one attachment end extending towards the door, an escutcheon having a front with an axial opening in which the attachment end is disposed, and a back having a flange around a rear opening. The flange is of a size such that the escutcheon cannot pass completely through the door aperture.

There is also a fastener having a back end with a flange around a rearwardly directed recessed grip, the fastener is positioned through the door aperture, the fastener flange being sized such that it prevents the fastener from passing completely through the door aperture. The fastener is inserted in the rear opening of the escutcheon and mated with one of the escutcheon and the attachment end so that the flanges clamp the door between them around the aperture. When the parts are so assembled, the grip can be used to reposition the door from the rear side of the door.

These assemblies permit there to be handles than can easily be gripped on both sides of each door, even in a bypass system. Thus, a door can easily be opened even from the opposite side from which the towel bar projects. The assembly achieves this by providing a low-profile grip on one side of the door that extends inwardly through the door panel itself (rather than outwardly).

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to judge the scope of the invention.

BRIEF DESCRIPTION OF THE DRAWINGS

FIG. 1 is a front view of a shower enclosure on which is mounted assemblies of the present invention;

FIG. 4 is an enlarged view, partially in section, taken along line 4—4 FIG. 1.

DETAILED DESCRIPTION OF THE PREFERRED EMBODIMENTS

Figure 2:
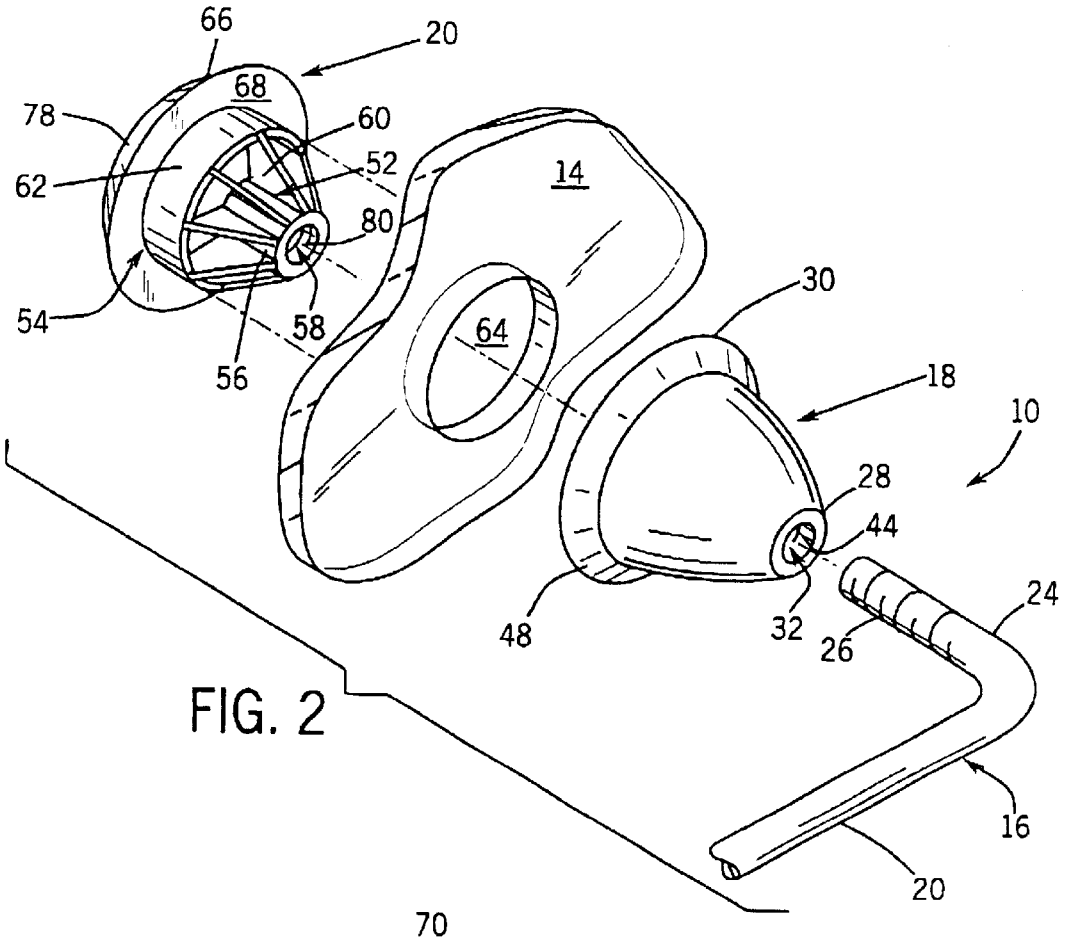
FIG. 2 is a cut-away exploded view of one end connection of a towel bar of FIG. 1.
Figure 3:
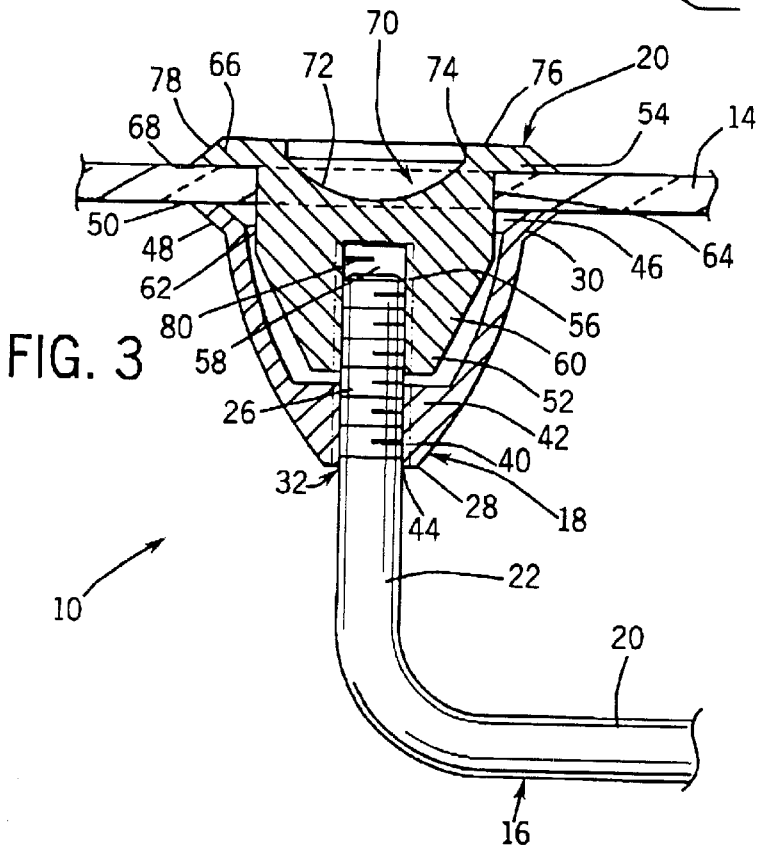
FIG. 3 is a cross-sectional view taken along line 3—3 of FIG. 1.

A towel bar 10 of the present invention is used with standard bypass-style shower doors 12, 14 covering an entry to a conventional shower stall 15. Each door 12, 14 is preferably a single panel of glass free from framing at its sides. One towel bar 10 can be suitably mounted to each of the doors 12, 14.

The towel bar 10 includes a bar 16, two escutcheons 18, and two nut/fasteners 20. The bar 16 preferably comprises a tubular rod having a region 20 for hanging towels and having two attachment ends 22, 24 extending substantially perpendicular. The ends 22, 24 include an engagement member 26, preferably consisting of external threads.

Each escutcheon 18 is preferably bell-shaped having a front 28 and a rear 30. At the front 28 an axial bore 32 extends into each escutcheon 18 to define a cylindrical hub 40 supported at its circumference by walls 42 extending to an interior surface of each escutcheon 18. Each door 12, 14 has a set of two suitably located door apertures 64. Each axial bore 32 includes a front engagement member 44, preferably consisting of internal threads matable with the threads 26. At the rear there is a large opening 46 of increased diameter than, and concentric with, the axial bore 32. A circumferential flange 48 extends around the periphery of the rear 30 of each escutcheon 18. Each flange 48 is sized larger than a corresponding aperture 64 and defines a catch surface 50, as will be described.

Each fastener 20 includes a front end 52 and a back end 54, with the front end 52 sized to fit within a corresponding escutcheon 18 through the rear side opening 46. The front end 52 of each fastener defines a cylindrical hub 56 having an axial opening, such as bore 58, concentric with the axial bores 32 of the escutcheons. The hub 56 is supported by a plurality of radially extending walls 60 tapering from the front end 52 to an annular surface 62 having a circumference sized to fit within a corresponding door aperture 64 and escutcheon rear side opening 46.

The end 54 of each fastener 20 defines a circumferential flange 66 of a greater diameter than the annular surface 62 and having a catch surface 68 similar to that of the escutcheons 18. Also at the back end 54 of each fastener 20 is a recessed grip 70, preferably in the form of a cupped surface 72 extending inwardly toward a door within the diameter of the annular surface 62. At the periphery of the cupped surface 72, a lateral ridge 74 extends outwardly to a back surface 76 of each fastener 20. The back surface 76 joins the catch surface 68 at a chamferred edge 78. The axial bore 58 of each fastener 20 includes an internal engagement member 80 preferably consisting of threads matable with the threads 26 of a corresponding towel support attachment end 22, 24.

The towel bar 10 is attached to a shower door 14 by inserting the end 52 of each fastener 20 into the corresponding apertures 64 in the door 14. The apertures 64 are sized to receive the annular surface 62 of the fastener 20, but have a diameter less than that of the flange 66. In this way, each flange catch surface 68 will prevent the fastener 20 from passing completely through the door apertures 64.

The front end 52 of the fasteners 20 will project past the thickness of the doors 12, 14 and will be disposed within the escutcheons 18. The front end 52 of the fasteners 20 and the cylindrical hub 40 of the escutcheons 18 are sized so that when assembled, each escutcheon flange catch surface 48 will contact an opposite surface of one of the doors 12, 14. The attachment ends 22, 24 of the towel support 16 can be threaded into the bore 32 in the escutcheons 18. Each towel bar is secured to the shower doors 12, 14 by rotating the escutcheons 18 and the fasteners 20 until the catch surfaces 50, 68 press firmly against each side of the doors 12, 14. An optional gasket (not shown) or sealant may be positioned at the catch surfaces 50, 68 of the escutcheons 18 and fasteners 20 to further ensure that water does not leak through the door apertures 64.

Referring to FIG. 4, a towel bar 10 of the present invention is attached to each door 12, 14 of a bypass shower door with the bar 16 extending outwardly on the outer door 14 and inwardly on the inner door 12. The towel bars 10 thus do not interfere with the sliding motion of the doors 12, 14 because of the narrow profile of the fasteners 20.

Importantly, each door 12, 14 may be opened from both sides using either the bar 16 or the recessed grips 70. The doors 12, 14 can be opened at the fastener side by inserting a finger or thumb into one or both of the recessed grips 70 and applying a slightly inward and sideways pressure on the cupped surface 72. Thus, the towel bar 10 of the present invention provides "handles" at both sides of the doors 12, 14, while maintaining a sufficiently narrow gap 90 between the doors so that water will not normally leak outside the shower stall at the gap 90. Also, the present invention permits the towel bar 10 to be mounted directly to a glass or plastic panel, so that no frame is needed for mounting the handle. This reduces material costs and provides for more pleasant looking shower doors. Moreover, the towel bar is not constrained by the size and location of a door frame, such that it can be any suitable length and configuration.

FIGS. 5A–5F show alternate end connections of the towel bar 10 to the doors 12, 14. For each embodiment, both end connections are identical, therefore, only one is shown and described. Similar parts are shown with similar numerals, albeit with a suitable designation such as "A," "B," "C" where the part is different.

Figure 5A:
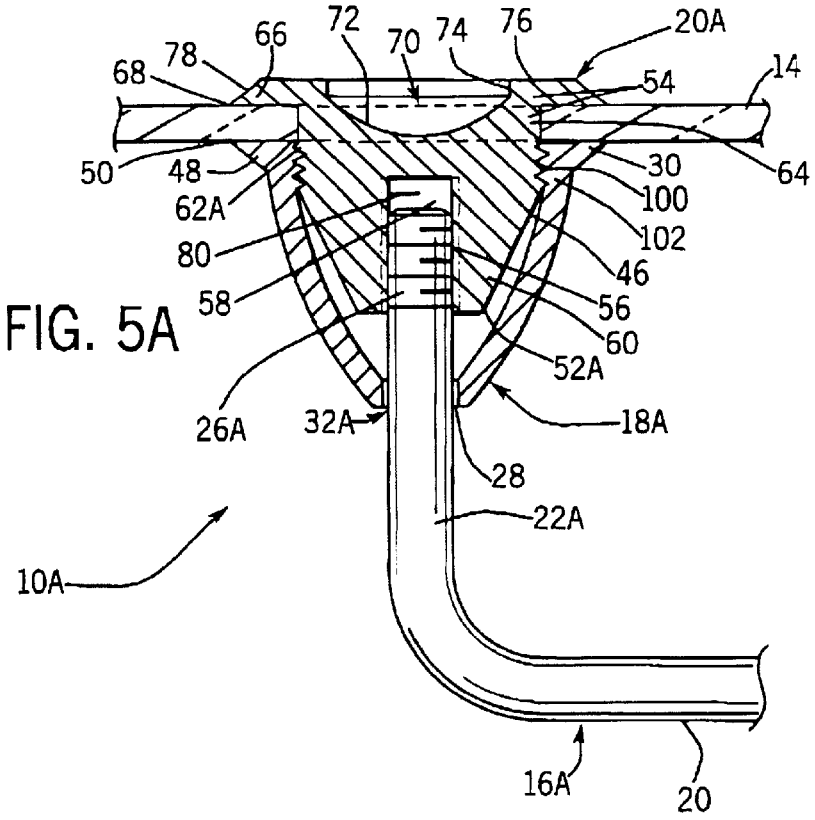
FIGS. 5A–5F show cross-sections of alternate end connections of the towel bar of the present invention.

Referring in particular to FIG. 5A, a towel bar 10A has a fastener 20A identical to that described above. However front threads 100, at annular surface 62A, mate with rear threads at the interior of an escutcheon 18A. In this embodiment, the escutcheon 18A does not have threads at an axial bore 32A such that end engagement member 26A of a bar 16A attachment end 22A mates only with the internal engagement member 58 of the fastener 20A and not with the escutcheon 18A. As such, this embodiment does not include a cylindrical hub around the axial bore 32A or interior hub support walls.

Figure 5B:
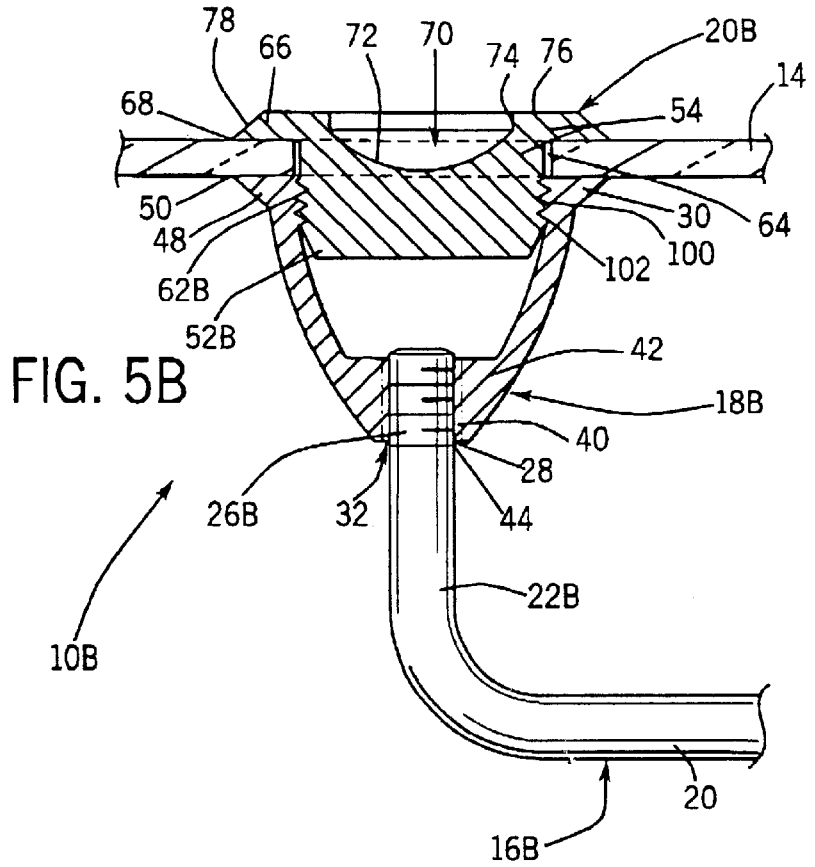

Referring next to FIG. 5B, a towel bar 10B has an escutcheon 18B with front 44 and rear 102 threads. The front threads at the axial bore 32 mate with end engagement member 26B of a towel support 16B attachment end 22B and the rear threads at the interior of the escutcheon 18B mate with the external engagement member 100 at a annular surface 62B of a fastener 20B, as in embodiment 10A. In this embodiment, the front end 52B of the fastener 20B does not include an axial bore or internal threads and is not directly mated with the towel support.

Figure 5C:
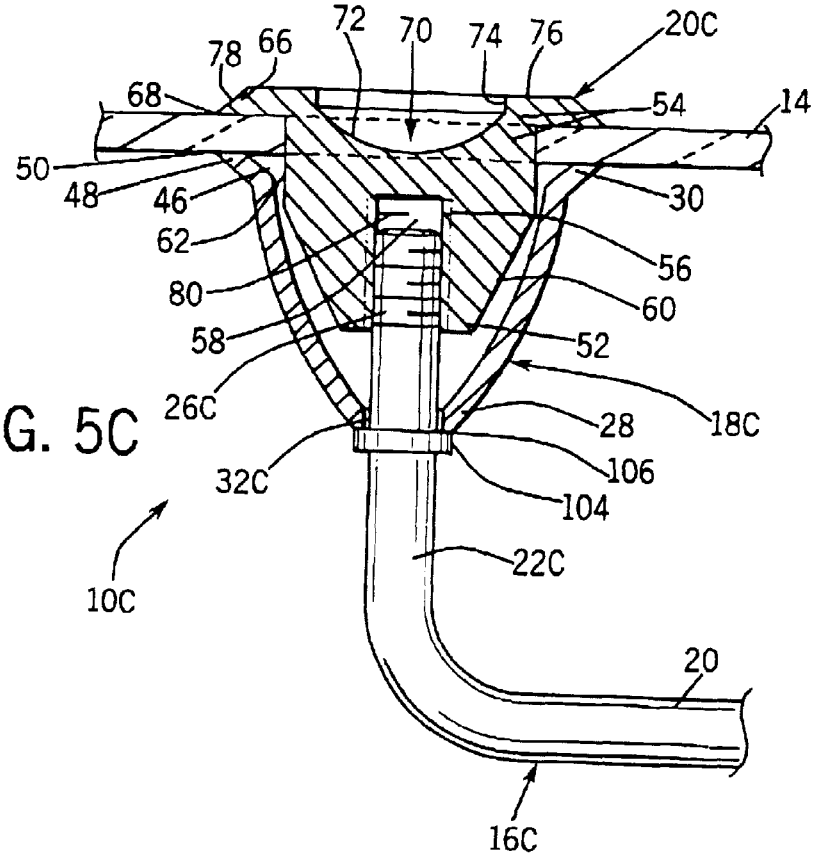

Referring to FIG. 5C, a towel bar 10C has an escutcheon 18C with no engagement members and a fastener 20C with only the internal engagement member 80, preferably threads, at the axial bore 58 for mating with end engagement member 26C of a towel support 16C attachment end 22C. A stop member 104 is suitably located along the towel support 16C which retains the escutcheons 18C to the door 14 by contacting an outer surface 106 at the front side 28 of the escutcheon 18C. The stop member 104 is preferably a fixed annular ring, but it can be any suitable configuration provided it is sized larger than an axial bore 32C of the escutcheon 18C. Since axial bore is not threaded, the cylindrical hub and interior walls of the escutcheon of the preferred embodiment are not needed.

Figure 5D:
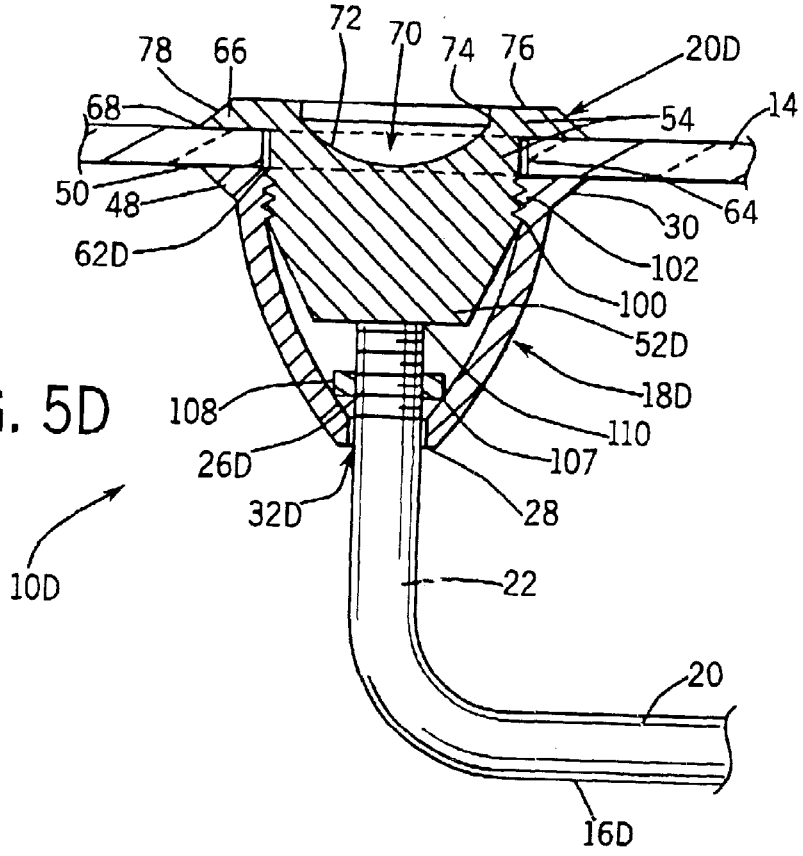

Referring to FIG. 5D, a towel bar 10D has a fastener 20D with the external engagement member 100 at its annular surface 62D matable with the rear engagement member 102 at the interior of an escutcheon 18D. In this embodiment, a front end 52D of a fastener 20D has no axial bore or internal engagement member. Moreover, an axial bore 32D of the escutcheon 18D does not include an engagement member. Rather, a preferably retractable or removable stop member 108, such as a nut, is fastened to end 22D at end engagement member 26D of a towel support 16D. The stop member 108 is sized larger than the axial bore 32D and contacts an interior ledge 107 of the escutcheon 18D. As such, the escutcheon 18D is secured to the fastener 20D and a towel support 16D is held in place by contact of the fastener 20D to an end surface 110 of the towel support 16D and the stop member 108 to the ledge 107. Since the escutcheon 18D does not include a threaded axial bore, no cylindrical hub and interior walls are needed.

Figure 5E:
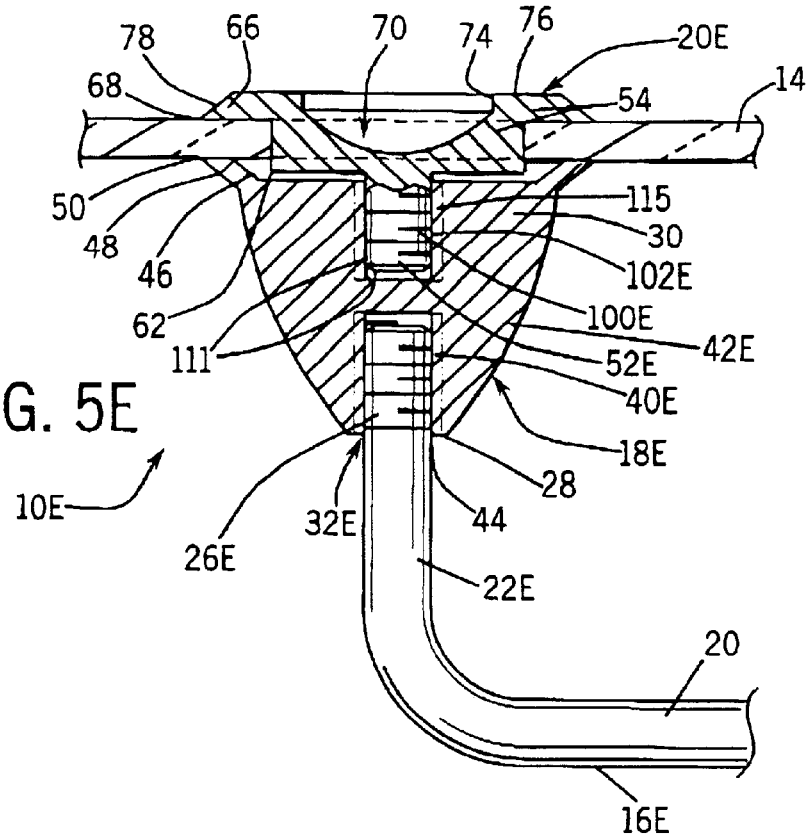

Referring to FIG. 5E, in towel bar 10E, a front end 52E of a fastener 20E has a smaller diameter than that of the embodiments described above defining a threaded rod or bolt-like end. In this embodiment, an escutcheon 18E has separate axial bores 32F and 111 with respective front 44 and rear 102E engagement members, preferably threads. Hub 113 defines the axial bore 111 and is supported by interior walls 42E, which also support the hub 40E of axial bore 32E. The front 44 and rear 102E engagement members mate with external engagement member 100E of the fastener 20E and an end engagement member 26E of attachment end 22E of the towel support 16E, respectively. The bottom of each axial bore 32E, 111 can provide a positive stop for the fastener 20E and towel support 16E.

Figure 5F:
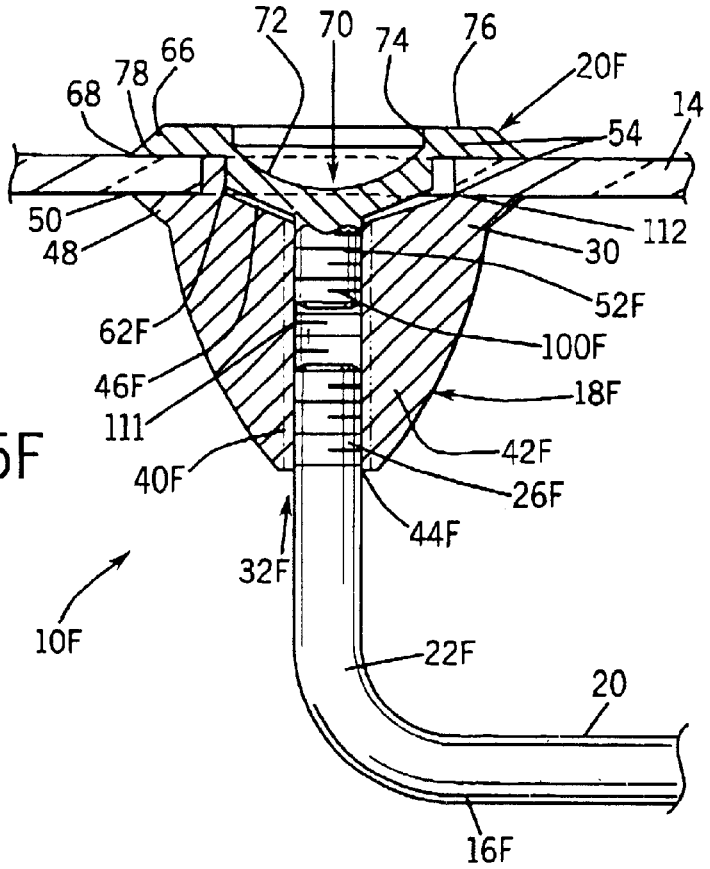

Referring to FIG. 5F, in still another alternate embodiment 10F, a front end 52F of a fastener 20F may be a threaded rod (as in towel bar 10E) that mates at external engagement member 100F with engagement member 44F within a lengthwise axial bore 32F of an escutcheon 18F. The bore 32F is defined and supported by hub 40F and radial walls 42F. The other end of the axial bore 32F mates with the engagement member 26F of the towel support 16F attachment end 22F. Also, in this embodiment, the escutcheon 18F may have a suitably configured opening 46F and annular surface 112 for fitting around the annular surface 62F of the recessed grip 70 and within the door aperture 64.

Industrial Applicability

The above disclosure provides a towel bar for use with bypass-style shower doors.

We claim:

1. A towel bar assembly for mounting on a door having an opening therethrough, comprising:

a towel bar having at least one attachment end;

an escutcheon having a front with an axial opening along which the attachment end is axially disposed, and a back having a flange around a rear opening; and a fastener having a back with a flange around a rearwardly directed recessed grip cavity;

wherein the fastener can be inserted through the door opening into the rear opening so as to mate with one of the escutcheon and the attachment end so that the flanges define a gap therebetween for being suitable to receive a portion of the door around the opening, and so that the recessed grip is accessible from the rear of the assembly during use.

2. The towel bar assembly of claim 1, wherein the recessed grip is a cupped surface.

3. The towel bar assembly of claim 1, wherein the bar also has a second attachment end, and the assembly further comprises a second escutcheon and a second fastener.

4. The towel bar assembly of claim 1, wherein the fastener has threads which mate with threads on the attachment end.

5. A door assembly, comprising:

a door having front and rear sides, and an aperture extending therebetween;

a towel bar having at least one attachment end extending towards the door;

an escutcheon having a front with an axial opening along which the attachment end is axially disposed, and a back having a flange around a rear opening, wherein the flange is of a size such that the escutcheon cannot pass completely through the door aperture; and a fastener having a back end with a flange around a rearwardly directed recessed grip cavity, the fastener being positioned through the door aperture, the fastener flange being sized such that it prevents the fastener from passing completely through the door aperture;

wherein the fastener is inserted in the rear opening of the escutcheon and mated with one of the escutcheon and the attachment end so that the flanges clamp the door between them around the aperture; and wherein the grip can be used to reposition the door from the rear side of the door.

6. The door assembly of claim 5, wherein the recessed grip is a rearwardly accessible cupped surface.

7. The door assembly of claim 5, wherein the fastener further comprises threads which mate with threads on the attachment end.

8. A door assembly, comprising:

a door having front and rear sides, and an aperture extending therebetween;

a bar having at least one attachment end extending towards the door;

an escutcheon having a front with an axial opening in which the attachment end is disposed, and a back having a flange around a rear opening, wherein the flange is of a size such that the escutcheon cannot pass completely through the door aperture; and a fastener having a back end with a flange around a rearwardly directed recessed grip, the fastener being positioned through the door aperture, the fastener flange being sized such that it prevents the fastener from passing completely through the door aperture;

wherein the fastener is inserted in the rear opening of the escutcheon and mated with one of the escutcheon and the attachment end so that the flanges clamp the door between them around the aperture;

wherein the grip can be used to reposition the door from the rear side of the door; and wherein the bar also has a second attachment end, and the assembly further comprises a second escutcheon and a second fastener connecting the second attachment end to the door at a second aperture through the door.

* * * * *